US008851770B2

(12) United States Patent
Ikeda et al.

(10) Patent No.: US 8,851,770 B2
(45) Date of Patent: Oct. 7, 2014

(54) PRINTING APPARATUS

(75) Inventors: Yasuhiko Ikeda, Sagamihara (JP); Masahito Yoshida, Shiki (JP); Koichiro Kawaguchi, Yokohama (JP); Kenji Shigeno, Yokohama (JP); Toshiki Takeuchi, Yokohama (JP); Masato Izumi, Kawasaki (JP); Ryosuke Sato, Kawasaki (JP); Kengo Nieda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 561 days.

(21) Appl. No.: 12/949,717

(22) Filed: Nov. 18, 2010

(65) Prior Publication Data

US 2011/0280642 A1 Nov. 17, 2011

(30) Foreign Application Priority Data

May 11, 2010 (JP) ..... 2010-109544

(51) Int. Cl.
*B41J 3/60* (2006.01)
*B41J 11/00* (2006.01)
*B41J 11/42* (2006.01)

(52) U.S. Cl.
CPC *B41J 3/60* (2013.01); *B41J 11/008* (2013.01); *B41J 11/42* (2013.01)
USPC ..... 400/188; 400/611; 399/401; 399/384; 399/388

(58) Field of Classification Search
USPC ..... 399/401, 394, 23, 21, 384, 388; 400/611, 188; 271/291
See application file for complete search history.

(56) References Cited

U.S. PATENT DOCUMENTS

| | | | | |
|---|---|---|---|---|
| 5,709,484 | A * | 1/1998 | Dorner | 400/188 |
| 6,729,780 | B2 * | 5/2004 | Sampson et al. | 400/74 |
| 2009/0003854 | A1 * | 1/2009 | Naoi et al. | 399/38 |

FOREIGN PATENT DOCUMENTS

JP 2009-6655 A 1/2009

* cited by examiner

*Primary Examiner* — Matthew G Marini
(74) *Attorney, Agent, or Firm* — Canon USA, Inc., IP Division

(57) ABSTRACT

A control unit includes a memory storing correction data obtained by associating information acquired by a first acquisition unit (rotary encoder) with information acquired by a second acquisition unit (direct sensor) with respect to, at least one rotation of a conveying roller. When a plurality of images are sequentially printed on a first surface and a second surface of a continuous sheet, the control unit reads the correction data corresponding to the rotation information acquired by the first acquisition unit from the memory and corrects at least one of driving control of a print head and driving control of the roller. The correction data used in printing on the first surface of the sheet is different from that used in printing on the second surface of the sheet.

17 Claims, 8 Drawing Sheets

PRINTING APPARATUS

BACKGROUND OF THE INVENTION

1. Field of the Invention

The present invention relates to printing apparatuses that convey sheets and perform printing.

2. Description of the Related Art Japanese Patent Laid-Open No. 2009-6655 discloses a printing apparatus that directly measures the speed of a sheet surface using a speed sensor to control the timing at which ink is ejected from print heads. FIG. 8 is a simplified diagram showing a printing apparatus disclosed in FIG. 25 of Japanese Patent Laid-Open No. 2009-6655. A roll of sheet 500 is conveyed by a conveying roller pair 501 on the upstream side and a conveying roller pair 502 on the downstream side and is subjected to printing by print heads 503. A speed sensor 504 (a laser Doppler sensor) that directly measures the moving speed of the sheet is disposed between the conveying roller pair 501 on the upstream side and the print heads 503. The timing of driving the print heads 503 is corrected based on the sheet conveyance speed measured by the speed sensor 504, thereby achieving high-quality printing.

In fields requiring mass printing, for example, printing labs, increasing printing speed while maintaining image quality is a problem. In addition, a demand for duplex printing, in which printing is performed on both surfaces of a sheet, is increasing because it enables production of photo books etc.

The apparatus disclosed in Japanese Patent Laid-Open No. 2009-6655 can sequentially print a plurality of images on one side of a continuous sheet. However, it is not designed to print on both surfaces of a sheet. In duplex printing, the first surface and second surface of the sheet, with which a conveying roller comes into contact, have different coefficients of friction. In particular, when ink is applied, the coefficient of friction of the sheet surface changes significantly. As a result, the slippage between the conveying roller and the sheet surface in printing on the second surface is different from that in preceding printing on the first surface, whereby the sheet conveyance condition is different even if the same driving force is applied. Therefore, if the same correction is performed in printing on the first surface and on the second surface with the method disclosed in Japanese Patent Laid-Open No. 2009-6655, the image on the second surface has a size different from the originally intended size. Thus, the images on the front and back sides have different sizes.

Furthermore, the laser Doppler sensor used in the apparatus disclosed in Japanese Patent Laid-Open No. 2009-6655 temporarily stores measured information, performs signal processing, and outputs the result, because of its measurement principle. Thus, delay in detection due to complicated signal processing may limit the speed, which may prevent high-speed real-time correction and make it difficult to increase the printing speed (moving speed of the sheet).

SUMMARY OF THE INVENTION

In view of the above-described problems, the present invention provides a printing apparatus capable of duplex printing, which can precisely print images on both surfaces of a sheet and achieve high printing throughput.

Furthermore, in the apparatus disclosed in Japanese Patent Laid-Open No. 2009-6655, the speed sensor is disposed between the conveying roller on the upstream side and the print heads. Because the speed sensor (laser Doppler sensor) requires a large installation space, the distance between the conveying roller and the print heads is large. This increases the likelihood of the leading end of the sheet floating and touching nozzles in the print head on the most upstream side, when the sheet is introduced and passes from the conveying roller to the print heads. In order to prevent such a situation, the distance between the speed sensor and the print heads needs to be reduced as much as possible. However, the smaller the distance between the speed sensor and the print heads, the more the following problems become apparent.

1. It is more likely to fail in completing calculation by the speed sensor and control of ink ejection timing from when the sheet passes through a measurement position, where the speed sensor performs measurement, to when it reaches the print head on the most upstream side. Because this problem becomes significant as the sheet conveyance speed increases, it is difficult to increase the printing speed.

2. As the distance between a printing area, in which the print heads perform printing, and the measurement position of the speed sensor is reduced, the likelihood of cockling (local sheet floating), which occurs when the sheet absorbs ink immediately after printing, affecting the measurement position increases. Such floating of the sheet occurring at the sensor's measurement position can cause a measure error.

3. When the print heads move toward the speed sensor and there is no blockage therebetween, ink mist (fine ink droplets) produced and scattered when ink is ejected from the print heads tends to deposit on the speed sensor. Because the speed sensor (laser Doppler sensor) has a light emitting unit and a photodetector, ink mist deposited on the light emitting unit or the photodetector lowers the detection signal level, making it difficult to perform stable measurement.

In view of the above-described problems 1 to 3, the present invention also provides a printing apparatus that achieves both high-speed sheet conveyance and high measurement accuracy of the speed sensor and that can maintain high printing quality even in a long-term operation.

An apparatus capable of duplex printing includes a sheet feeding unit configured to feed a continuous sheet; a conveying mechanism including a roller provided with driving force, configured to convey the sheet; a printing unit including a line print head, configured to perform printing on the sheet conveyed by the conveying mechanism; a reverse unit configured to reverse the sheet for the duplex printing; a first acquisition unit configured to acquire rotation information of the roller; a second acquisition unit configured to acquire information about a movement state of the sheet by measuring a surface of the conveyed sheet; and a control unit including a memory storing correction data obtained by associating information acquired by the first acquisition unit with information acquired by the second acquisition unit with respect to at least one rotation of the roller. The control unit controls so that, in the duplex printing, the printing unit performs printing a plurality of images on a first surface of the sheet fed from the sheet feeding unit, the printed sheet is reversed by the reverse unit to feed the reversed sheet to the printing unit, and the printing unit performs printing a plurality of images on a second surface, which is the back of the first surface, of the sheet fed from the reverse unit. The control unit reads the correction data corresponding to the rotation information acquired by the first acquisition unit from the memory during printing to correct at least one of driving control of the print head and driving control of the roller, and allows different correction data to be used in printing on the first surface and in printing on the second surface.

According to the present invention, the printing apparatus achieves high printing quality and high printing throughput.

Further features of the present invention will become apparent from the following description of exemplary embodiments with reference to the attached drawings.

DESCRIPTION OF THE EMBODIMENTS

An embodiment of a printing apparatus employing an ink jet method will be described. A printing apparatus of this example is a high-speed line printer that uses a long continuous sheet (a continuous sheet that is longer than a repeating printing unit, i.e., "one page" or "a unit image", in the conveying direction and that can be used in both simplex printing and duplex printing. Such a printing apparatus is suitable for use in, for example, printing labs, in which mass printing is required. Note that, herein, a plurality of small images, letters, and blank spaces existing in the area of one printing unit (one page) are collectively referred to as one unit image. That is, a unit image means one printing unit (one page) in the case where a plurality of pages are sequentially printed on a continuous sheet. The length of a unit image depends on the size of the image to be printed. For example, an L-sized picture has a length of 135 mm in the sheet conveying direction, and an A4-sized sheet has a length of 297 mm in the sheet conveying direction.

The present invention can be widely applied to printing apparatuses such as printers, printer multifunction devices, copiers, facsimile apparatuses, and various apparatuses for producing devices. The printing may be performed by any method, for example, an ink jet method, an electrophotography method, a thermal transfer method, a dot impact method, and a liquid development method. Furthermore, the present invention can be applied to sheet processing apparatuses that perform not only printing, but also various processing (recording, machining, applying, irradiation, reading, inspecting, and the like) on continuous sheets. In such cases, instead of the print heads, processing heads that perform processing other than printing are used.

Figure 1:
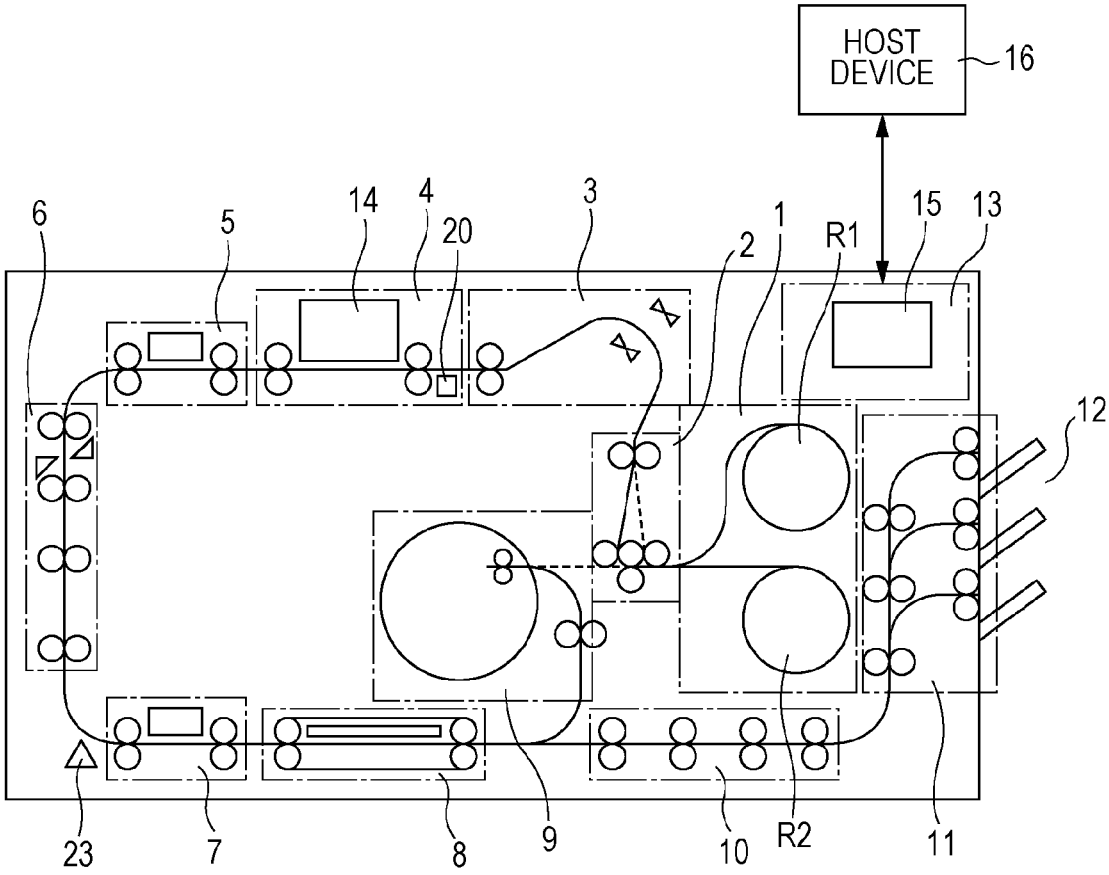
FIG. 1 is a schematic view showing the internal configuration of a printing apparatus.

FIG. 1 is a schematic cross section showing the internal configuration of the printing apparatus. The printing apparatus according to this embodiment can perform duplex printing, in which printing is performed on a first surface of a sheet and a second surface of the sheet opposite the first surface, using a roll of sheet. The printing apparatus mainly includes a sheet feeding unit 1, a decurling unit 2, a skew correction unit 3, a printing unit 4, an inspecting unit 5, a cutter unit 6, an information recording unit 7, a drying unit 8, a reverse unit 9, a discharge conveyance unit 10, a sorter unit 11, a discharge unit 12, and a control unit 13. A sheet is conveyed by a conveying mechanism including roller pairs and a belt along a sheet conveyance path indicated by a solid line in FIG. 1 and is subjected to processing in the respective units. Note that, at any position along the sheet conveyance path, the side close to the sheet feeding unit 1 is referred to as the "upstream side" and the opposite side is referred to as the "downstream side".

The sheet feeding unit 1 holds rolls of continuous sheet and feeds the sheets. The sheet feeding unit 1 can accommodate two rolls, namely, a roll R1 and a roll R2, and selectively draws and feeds the sheet. The number of rolls accommodated in the sheet feeding unit 1 is not limited to two, but may be one or more than two. Furthermore, as long as the sheet is continuous, the form of the sheet is not limited to a rolled form. For example, a continuous sheet having perforation lines provided at every unit length may be stored in the sheet feeding unit 1 so as to be folded at the perforation lines and stacked.

The decurling unit 2 reduces the curl (bending) of the sheet fed from the sheet feeding unit 1. In the decurling unit 2, using one driving roller and two pinch rollers, the sheet is allowed to pass therethrough in a curved manner such that it is bent in the direction opposite the curl. Thus, a decurling force is exerted to reduce the curl.

The skew correction unit 3 corrects a skew (an inclination with respect to the intended moving direction) of the sheet having passed through the decurling unit 2. By abutting the end of the sheet, serving as the reference, against a guiding member, the skew of the sheet is corrected.

The printing unit 4 performs printing on the sheet with print heads 14 from above, thereby forming an image on the sheet. In other words, the printing unit 4 is a processing unit that performs predetermined processing on the sheet. The printing unit 4 also includes a plurality of conveying rollers that convey the sheet. The print heads 14 include line print heads having ink jet nozzle arrays provided in an area covering the maximum width of sheets that may be used. The print heads 14 are a plurality of print heads arranged in parallel in the conveying direction. In this example, the print heads 14 include seven print heads corresponding to seven colors, namely, cyan (C), magenta (M), yellow (Y), light cyan (LC), light magenta (LM), gray (G), and black (K). The number of colors and print heads is not limited to seven. Examples of the ink jet method include a method using heater elements, a method using piezoelectric elements, a method using electrostatic elements, a method using micro electro mechanical systems (MEMS) elements, and the like. The ink of respective colors is supplied from ink tanks to the print heads 14 through ink tubes.

A direct sensor 20, which directly measures the sheet surface at a predetermined measurement position to acquire information about the movement states (the moving speed and the moving distance) of the sheet, is provided on the upstream side of the print heads 14 in the printing unit 4. Furthermore, a mark reader 122 that reads a mark formed on the sheet by the print heads 14 from the back side of the measurement position is provided. Detailed description of the direct sensor 20 and the mark reader 122 will be given below.

The inspecting unit 5 optically reads an inspecting pattern or image printed on the sheet by the printing unit 4 with a scanner to inspect the conditions of the nozzles in the print heads, the sheet conveyance conditions, the position of the image, etc., and determine if the image is appropriately printed. The scanner includes a charge coupled device (CCD) image sensor or a complementary metal oxide semiconductor (CMOS) image sensor.

The cutter unit 6 includes a mechanical cutter that cuts the sheet to a predetermined length after printing. The cutter unit 6 also includes a plurality of conveying rollers that send the sheet to a next step.

The information recording unit 7 records printing information (specific information), such as a serial number or a date, in a non-printing area of the sheet after cutting. The recording is performed by printing letters or codes by an ink jet method or a thermal transfer method. A sensor 23 that detects the leading end of the sheet after cutting is provided on the upstream side of the information recording unit 7 and on the downstream side of the cutter unit 6. That is, the sensor 23 detects the end of the sheet between the cutter unit 6 and the information recording unit 7 where recording is performed, and the timing at which the information recording unit 7 records information is controlled on the basis of the detection by the sensor 23.

The drying unit 8 heats the sheet having undergone printing in the printing unit 4 to dry the ink in a short time. In the drying unit 8, heated air is blown onto the sheet from, at least, the lower surface to dry the surface provided with ink. Note that the method for drying is not limited to the method in which heated air is blown, but may be a method in which the sheet surface is irradiated with an electromagnetic wave (such as ultraviolet rays or infrared rays).

The above-described sheet conveyance path extending from the sheet feeding unit 1 to the drying unit 8 is referred to as a "first path". The first path has a U shape between the printing unit 4 and the drying unit 8, and the cutter unit 6 is positioned in the middle of the U.

The reverse unit 9 temporarily takes up the continuous sheet having been printed on the front side and reverses it when duplex printing is to be performed. The reverse unit 9 is provided in the middle of a path (loop path, referred to as a "second path") along which the sheet having passed through the drying unit 8 is fed back to the printing unit 4. The path extends from the drying unit 8 via the decurling unit 2 to the printing unit 4. The reverse unit 9 includes a winding rotary member (drum) rotated to take up the sheet. The continuous sheet having been printed on the front side and not yet cut is temporarily taken up on the winding rotary member. When the sheet is completely taken up, the winding rotary member is reversely rotated, feeding the taken up sheet to the decurling unit 2 and sending it to the printing unit 4. Because the sheet is reversed, it is possible to perform printing on the back side in the printing unit 4. The operation of duplex printing will be described in more detail below.

The discharge conveyance unit 10 conveys the sheet cut by the cutter unit 6 and dried by the drying unit 8 to the sorter unit 11. The discharge conveyance unit 10 is provided in a path (referred to as a "third path") that is different from the second path where the reverse unit 9 is provided. In order to selectively guide the sheet having been conveyed along the first path to one of the second and third paths, a path-switching mechanism having a movable flapper is provided at a position where the path branches.

The sorter unit 11 and the discharge unit 12 are provided to the side of the sheet feeding unit 1, at the terminal end of the third path. The sorter unit 11 sorts the printed sheets into groups if necessary. The sorted sheets are discharged into the discharge unit 12 including a plurality of trays. Thus, the third path is laid out such that it passes below the sheet feeding unit 1 and discharges the sheets to the side opposite the printing unit 4 and the drying unit 8 with respect to the sheet feeding unit 1.

The control unit 13 controls the respective units of the entire printing apparatus. The control unit 13 includes a control section having a central processing unit (CPU), storage devices, and various control devices (control section), an external interface, and an operating unit 15 through which a user performs input and output operations. The operation of the printing apparatus is controlled on the basis of commands from the control unit 13 or a host device 16, such as a host computer, connected to the control unit 13 through the external interface.

Figure 2:
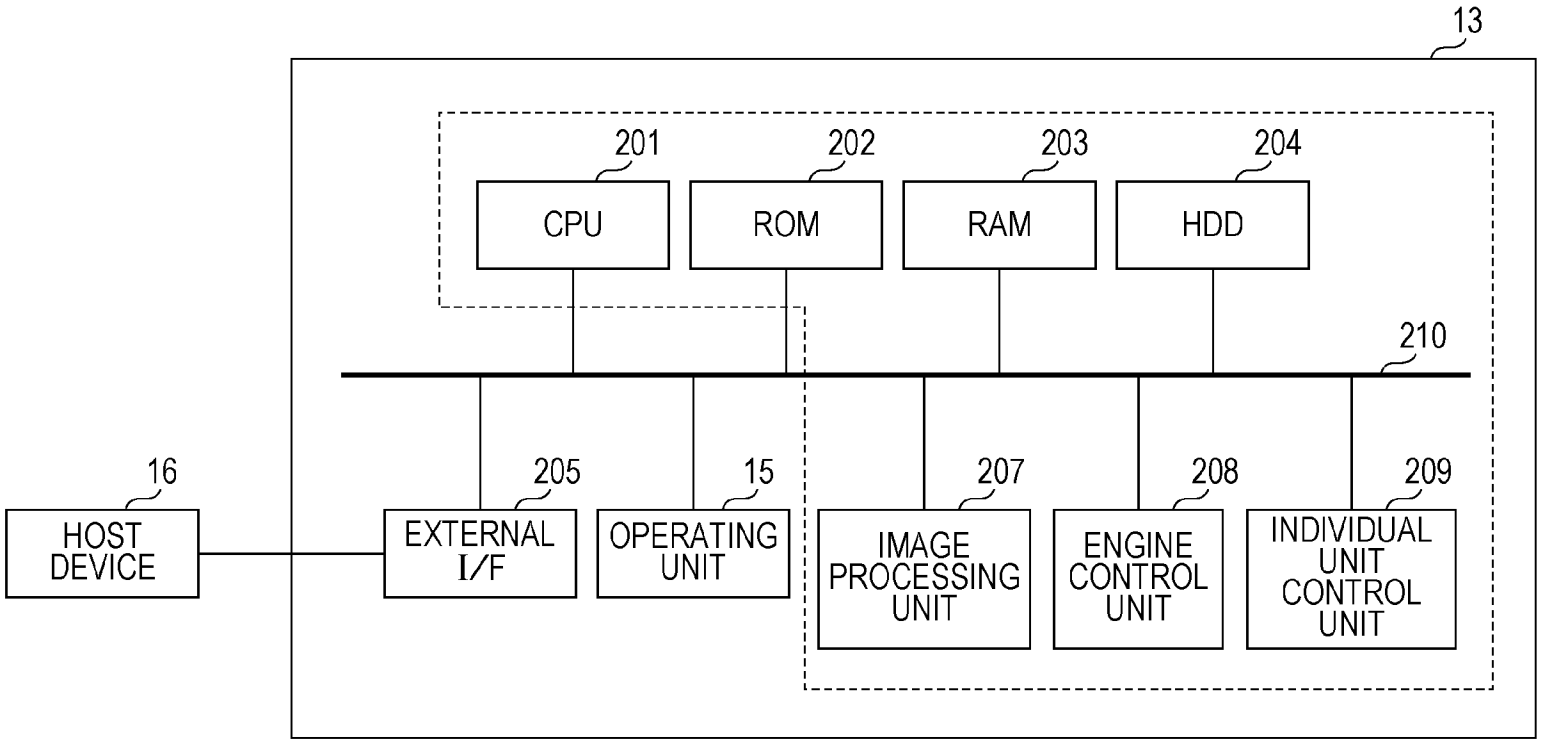
FIG. 2 is a block diagram of a control unit.

FIG. 2 is a block diagram of the control unit 13. The control section (surrounded by dashed line) in the control unit 13 includes a CPU 201, a read only memory (ROM) 202, a random access memory (RAM) 203, a hard disk drive (HDD) 204, an image processing unit 207, an engine control unit 208, and an individual unit control unit 209. The CPU 201 integrally controls the operations of the respective units of the printing apparatus. The ROM 202 stores programs to be executed by the CPU 201 and fixed data necessary for various operations of the printing apparatus. The RAM 203 serves as a work area for the CPU 201 or a temporary storage area for storing various received data, or it stores various setting data. The HDD 204 can store programs executed by the CPU 201, print data, and setting information necessary for various operations of the printing apparatus. The operating unit 15 serves as an input/output interface for a user and includes an input unit, such as hard keys or a touch panel, and an output unit that indicates information, such as a display or an audio output device. For example, using a display with a touch panel, the operation status of the apparatus, the printing status, and the maintenance information (the ink level, the sheet level, the maintenance status, etc.) are shown to the user. The user can input various information from the touch panel.

Units that are required to perform high-speed data processing have their own processing unit. The image processing unit 207 performs image processing of the print data handled by the printing apparatus. It converts the color space of the inputted image data (for example, YCbCr) to the standard RGB color space (for example, sRGB). Furthermore, various image processing, such as resolution conversion, image analysis, and image correction, is performed on the image data if necessary. The print data resulting from the image processing is stored in the RAM 203 or the HDD 204. The engine control unit 208 controls driving of the print heads 14 in the printing unit 4 according to the print data on the basis of the control command received from the CPU 201 or the like. The engine control unit 208 also controls the conveying mechanisms of the respective units in the printing apparatus. The engine control unit 208 includes a non-volatile memory (described below) that stores correction data. The individual unit control unit 209 serves as a sub-control unit that individually controls the sheet feeding unit 1, the decurling unit 2, the skew correction unit 3, the inspecting unit 5, the cutter unit 6, the information recording unit 7, the drying unit 8, the reverse unit 9, the discharge conveyance unit 10, the sorter unit 11, and the discharge unit 12. Detection signals from a rotary encoder 19, the direct sensor 20, and other sensors (described below) are inputted to the control unit 13. The operations of the respective units are controlled by the individual unit control unit 209 on the basis of the command from the CPU 201. An external interface 205 is an interface (I/F) through which the control unit 13 is connected to the host device 16, and it is a local I/F or a network I/F. The above-described components are connected to one another via a system bus 210.

The host device 16 supplies image data to the printing apparatus. The host device 16 is either a general-purpose computer or a specific-purpose computer. Alternatively, it may be a specific-purpose imaging apparatus, such as an image capture having an image reader, a digital camera, or a photo storage. In the case where the host device 16 is a computer, an operating system (OS), application software for generating image data, and a printer driver for printing apparatus are installed in a storage device of the computer. Note that there is no need for software to perform all the above-described processing, and hardware may perform some or all of the above-described processing.

Next, the basic operation during printing will be described. Because the printing operation in the simplex printing mode is different from that in the duplex printing mode, they are described separately.

Figure 3A:
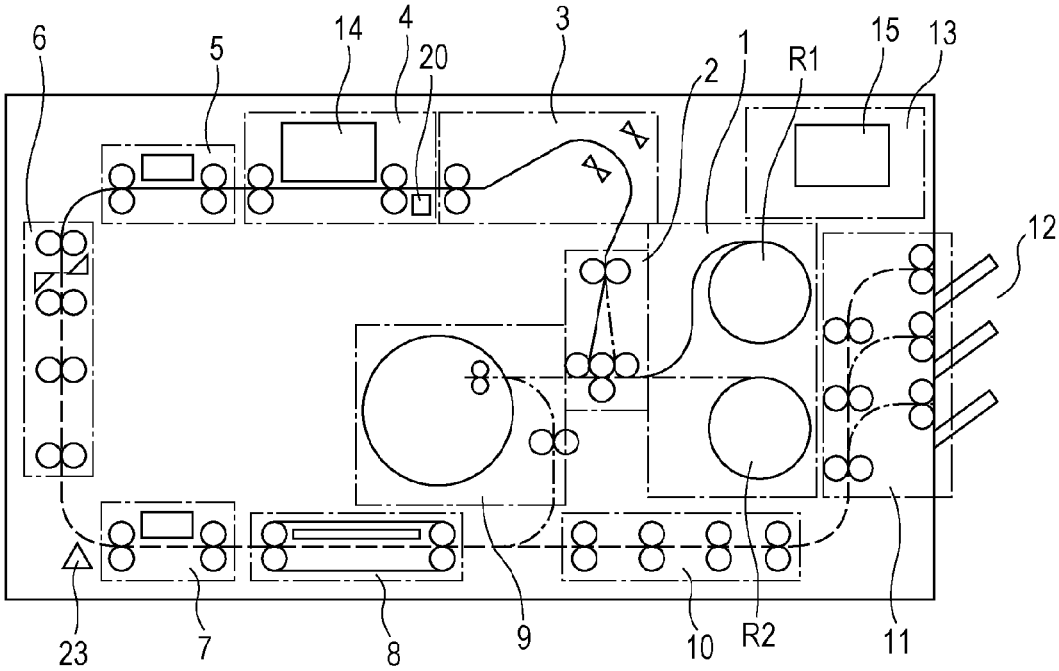
FIGS. 3A and 3B show operations in a simplex printing mode and a duplex printing mode.

FIG. 3A is a diagram for describing the operation in the simplex printing mode. A sheet fed from the sheet feeding unit 1 and processed in the decurling unit 2 and the skew correction unit 3 is subjected to printing on the front side (first surface) at the printing unit 4. By sequentially printing images (unit images) having a predetermined unit length in the conveying direction on the long continuous sheet, a plurality of images are formed in a side-by-side manner. The printed sheet passes through the inspecting unit 5 and is cut into each unit image by the cutter unit 6. Printing information is recorded on the back sides of the cut sheets at the information recording unit 7, if necessary. Then, the cut sheets are conveyed one by one to the drying unit 8 and are dried. Thereafter, the cut sheets pass through the discharge conveyance unit 10 and are sequentially discharged and stacked on the discharge unit 12 of the sorter unit 11. On the other hand, the sheet remaining on the printing unit 4 side after the final unit image is cut is sent back to the sheet feeding unit 1 and is taken up on the roll R1 or the roll R2. Thus, in the simplex printing, the sheet passes through the first and third paths and is processed therein, but it does not pass through the second path.

Figure 3B:
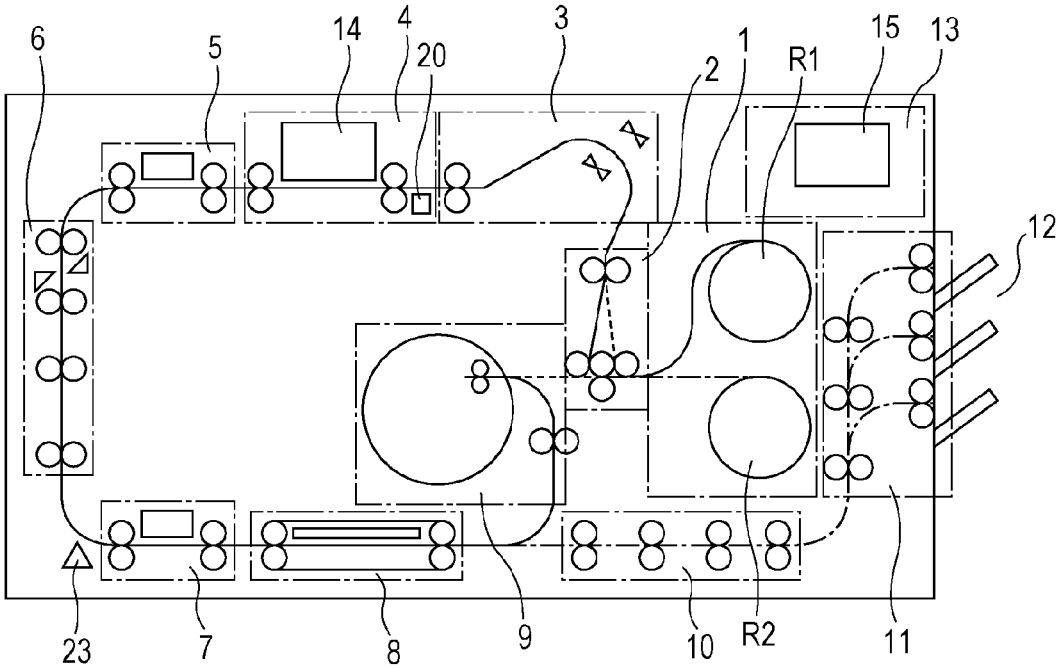

FIG. 3B is a diagram for describing the operation in the duplex printing mode. In duplex printing, after the front side (first surface) printing sequence, a back side (second surface) printing sequence is performed. In the front side printing sequence, which is performed first, the operations performed in the respective units are the same as those in the simplex printing, from the sheet feeding unit 1 to the inspecting unit 5. Then, the sheet is not cut by the cutter unit 6 and is conveyed to the drying unit 8 as the continuous sheet. After the ink on the surface is dried by the drying unit 8, the sheet is guided not to the path on the discharge conveyance unit 10 side (third path), but to the path on the reverse unit 9 side (second path). In the second path, the sheet is taken up on the winding rotary member of the reverse unit 9 rotated in a first direction (counterclockwise in FIG. 3B). After all the planned front side printing is performed in the printing unit 4, the trailing end of the printing area of the continuous sheet is cut by the cutter unit 6. Using the cutting position as the reference, the entire continuous sheet on the downstream side in the conveying direction (printed side), to the trailing end (cutting position) of the sheet, is taken up in the reverse unit 9 through the drying unit 8. On the other hand, at the same time with this taking up operation, the continuous sheet remaining on the upstream side of the cutting position in the conveying direction (on the printing unit 4 side) is taken up on the sheet feeding unit 1 such that the leading end of the sheet (cutting position) does not remain in the decurling unit 2, and the sheet is taken up on the roll R1 or the roll R2. This taking up operation prevents the sheet from interfering with the sheet fed in a back side printing sequence described below.

After the above-described front side printing sequence, the process is switched to the back side printing sequence. The winding rotary member of the reverse unit 9 is rotated in a second direction opposite the first direction (clockwise in FIG. 3B). The end (the trailing end of the sheet in taking up is the leading end of the sheet in feeding) of the sheet taken up is sent to the decurling unit 2 along the path indicated by the dashed line in FIG. 3B. The decurling unit 2 removes the curl of the sheet produced at the winding rotary member. That is, the decurling unit 2 is provided between the sheet feeding unit 1 and the printing unit 4 in the first path, and between the reverse unit 9 and the printing unit 4 in the second path. The decurling unit 2 is common to both paths and performs decurling. The sheet having been reversed passes through the skew correction unit 3 and is sent to the printing unit 4, where printing is performed on the back side of the sheet. The printed sheet passes through the inspecting unit 5 and is cut by the cutter unit 6 to a predetermined unit length. Because the cut sheets are printed on both sides, the information recording unit 7 performs no recording. The cut sheets are conveyed one by one to the drying unit 8, passes through the discharge conveyance unit 10, and is sequentially discharged and stacked on the discharge unit 12 of the sorter unit 11. Thus, in duplex printing, the sheets are processed while sequentially passing through the first path, the second path, the first path, and the third path.

Figure 4:
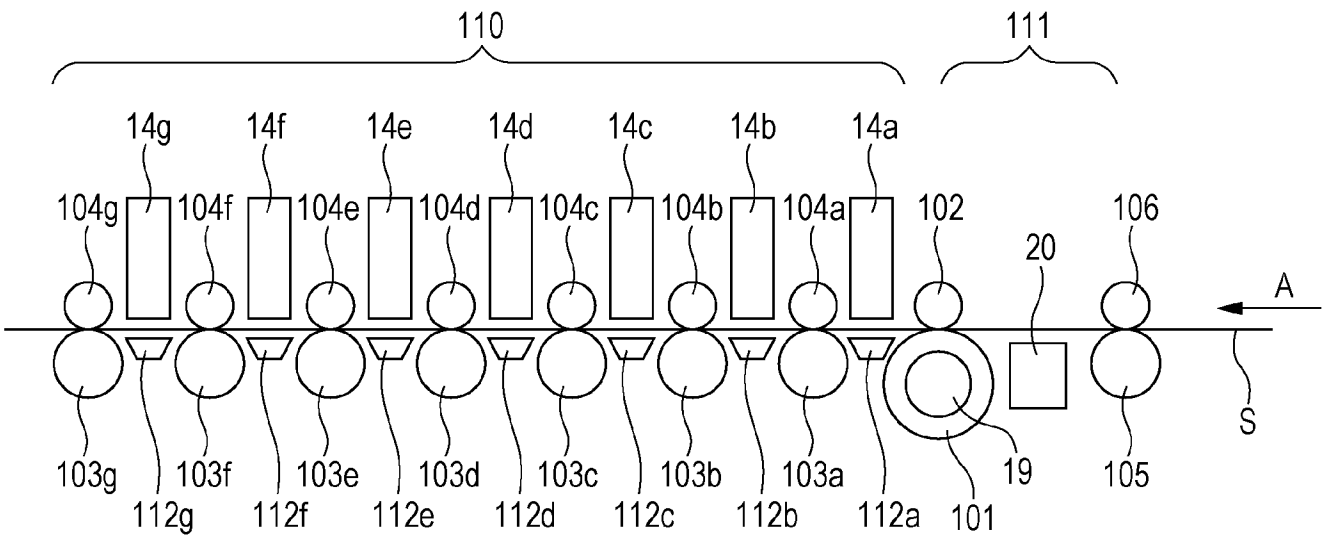
FIG. 4 shows the detailed configuration of a printing unit.

Next, the printing unit 4 of the printer having the above-described configuration will be described in more detail. FIG. 4 shows the configuration of the printing unit 4. In the printing unit 4, a sheet S is conveyed in the direction of arrow A by tree roller pairs, namely, a first roller pair, a second roller pair, and a third roller pair. The first roller pair includes a conveying roller 101 that exerts driving force and a pinch roller 102 that is rotated in a driven manner. The second roller pair refers to seven roller pairs including a plurality of conveying rollers 103*a* to 103*g* that exert driving force and a plurality of pinch rollers 104*a* to 104*g* that are rotated in a driven manner. The third roller pair includes a conveying roller 105 that exerts driving force and a pinch roller 106 that is rotated in a driven manner. The rotary encoder 19 (a first acquisition unit) that detects the rotation condition of the roller is provided on the conveying roller 101.

Seven line print heads 14*a* to 14*g* corresponding to respective colors are disposed in the sheet conveying direction in a printing area 110 on the downstream side of the first conveying roller pair. The print heads 14*a* to 14*g* and the pinch rollers 104*a* to 104*g* are disposed alternately. Platens 112*a* to 112*g* are provided at positions opposite the print heads 14*a* to 14*g* to support the sheet S. Because the sheet S is nipped by the roller pairs and supported by the platens opposite the print heads 14*a* to 14*g* on the upstream and downstream sides, the sheet S is conveyed stably. In particular, when the sheet S is initially introduced, because the leading end of the sheet S passes through a plurality of nip positions, the leading end of the sheet S is prevented from floating. Thus, the sheet S can be stably introduced.

The direct sensor 20 (a second acquisition unit) is a non-contact optical sensor that directly measures the sheet surface to directly acquire information about the movement state of the sheet (the moving speed or the moving distance) from the sheet. A measurement position 111 is between the nip position of the first roller pair and the nip position of the third roller pair. The direct sensor 20 acquires information about the movement state of the sheet by measuring the sheet surface (the back side of the printing side) at the measurement position 111. Because the direct sensor 20 is disposed at the back side of the sheet S, ink mist produced from the print heads 14 during printing is blocked by the sheet S, whereby degradation in detection performance due to the ink mist deposited on the sensor can be prevented. Note that the direct sensor 20 may be disposed at the front side of the sheet S. Furthermore, in this embodiment, two direct sensors 20 are provided in the sheet width direction. By providing two direct sensors 20 in the sheet width direction, it is possible to precisely measure the behavior of the sheet S even when the conveyance speed of the sheet S is different between two measurement positions (even when the sheet is skewed). In addition, even when one of the direct sensors 20 becomes incapable of measurement, the other direct sensor 20 can serve as a backup. Thus, the reliability improves. Note that the number of direct sensors 20 may be three or more, or only one.

In this example, the direct sensor 20 is a laser Doppler sensor. The laser Doppler sensor is a speed sensor that emits a laser beam onto a moving surface and detect Doppler shift to measure the moving speed or the moving distance. Because the detailed configuration and measurement principle of the laser Doppler sensor are described in the above-described Japanese Patent Laid-Open No. 2009-6655 and other documents, the description thereof will not be given here.

The direct sensor 20 may be a noncontact optical sensor other than the laser Doppler sensor. For example, there are direct sensors using image sensors (CCD image sensors or CMOS image sensors). Such a direct sensor captures images of a moving sheet surface time-sequentially at different times with a fixed image sensor, thereby acquiring a plurality of pieces of image data. Then, by comparing the pieces of image data with one another by, for example, a pattern matching method, the movement state (the moving distance or the moving speed) of the sheet is acquired. The direct sensor 20 may be a contact direct sensor in which the surface of the sensor is physically in contact with the surface of the sheet S.

The sheet S fed from the sheet feeding unit 1 is nipped at predetermined nip positions by, in sequence, the third roller pair, the first roller pair, and the second roller pair and is conveyed. The conveying path extending from the first roller pair to the third roller pair is a straight line. A "straight line" as used herein is not limited to an exact straight line, but may be a substantially straight line.

The conveying forces exerted by the roller pairs to convey the sheet are defined to satisfy the relationship in the following Expression 1.

first roller pair>second roller pair>third roller pair [Expression 1]

The conveying forces exerted by the roller pairs are determined by the nip forces of the pinch rollers. This is because a larger nip force causes less slippage between the sheet and the roller surfaces. The nip force is determined by the pressure of springs urging the pinch rollers against the conveying rollers. In this example, the pinch roller 102 of the first roller pair is subjected to a spring pressure of 20 kgf, the pinch rollers 104*a* to 104*g* of the second roller pair are subjected to, in total, a spring pressure 4 kgf, and the pinch roller 106 of the third roller pair is subjected to a spring pressure of 1 kgf. In this relationship, the first roller pair has the greatest influence on the sheet conveyance accuracy, and thus, by intensively improving the conveyance accuracy of the first roller pair, the overall sheet conveyance accuracy improves.

The sheet conveyance speeds of the roller pairs (the peripheral speeds of the conveying rollers) are defined to satisfy the relationship in the following Expression 2.

second roller pair>first roller pair>third roller pair [Expression 2]

A torque limiter is provided coaxially on the conveying roller 105 of the third roller pair. The torque limiter restricts the transmission of force by slipping when more than a predetermined rotational torque is applied. Because the conveying roller 105 has a slightly lower sheet conveyance speed than the conveying roller 101, the torque limiter of the conveying roller 105 is activated during conveyance and slightly reduces the speed of the conveying roller 105. Therefore, even if the conveying roller 105 is slightly eccentric or the shape of the roller is nonuniform, there is almost no influence on the overall sheet conveyance accuracy.

Because of the above-described relationship between the conveying force (Expression 1) and the sheet conveyance speed (Expression 2), almost no slippage occurs at the nip position (between the conveying roller 101 and the sheet S) of the first roller pair, which is the main conveying unit. A slippage due to the difference in speed occurs at the nip position (between the conveying rollers 103*a* to 103*g* and the sheet S) of the second roller pair. A slippage due to the difference in speed occurs at the nip position (between the conveying roller 105 and the sheet S) of the third roller pair, and the torque limiter of the conveying roller 105 is activated. By satisfying this relationship, the first roller pair determines the overall sheet conveyance speed. Furthermore, all the roller pairs apply a small tension to the sheet S, whereby the sheet is prevented from locally floating. Therefore, in the printing area 110, the distance between the sheet S and each print head 14 is constant, whereby high printing accuracy can be maintained. Furthermore, because the distance between the direct sensor 20 and the sheet S is also constant at the measurement position 111 of the direct sensor 20, the high measurement accuracy can be maintained.

The control section of the control unit 13 controls the timing at which ink is ejected from the nozzles in the print heads 14*a* to 14*g* (drive control timing) on the basis of the information about the sheet conveyance condition acquired by the measurement with the direct sensor 20. The ink ejection timing is basically controlled on the basis of the measurement value (the count of the detection pulse) measured by the rotary encoder 19 provided on the conveying roller 101. However, when the conveying roller 101 is slightly eccentric or when a slight slippage occurs between the conveying roller 101 and the sheet S, an error is generated between the measurement value measured by the rotary encoder 19 and the sheet conveyance speed (or the conveying distance). Because the direct sensor 20 directly measures the movement state of the sheet surface, it can acquire information about the sheet conveyance speed (or the conveying distance) with a higher accuracy than the rotary encoder 19. By determining the difference between the measurement value measured by the direct sensor 20 and the measurement value measured by the rotary encoder 19, information about the error is obtained. However, real-time measurement with the direct sensor during printing may make it difficult to increase the printing speed (the moving speed of the sheet) because detection delay due to complicated signal processing limits the speed. Thus, in this embodiment, correction data is acquired in advance and stored in the memory of the engine control unit 208, and correction is performed by reading the value in the memory during printing. That is, by reading the information about the error stored in the memory, the timing at which ink is ejected from the print heads 14*a* to 14*g* (the timing at which driving pulse signal is applied to the respective nozzles) is controlled. Thus, a slight conveying error caused by the conveying roller 101 is corrected by controlling the timing at which printing is performed by the print heads, whereby high-quality printing and high-speed printing are achieved at the same time.

The measurement result obtained by the direct sensor 20 may be fed back to the sheet conveyance control with print-timing correction or without print-timing correction, so that the conveying error is corrected. In sheet conveyance correction control, at least the sheet conveyance speed of the conveying roller 101 of the first roller pair is changed to correct the conveying error. More desirably, the sheet conveyance speeds of the second roller pair and third roller pair are also changed. That is, the control unit preliminarily stores the correction data for correcting at least one of driving control of the print heads and driving control of the rollers on the basis of the information acquired by the direct sensor 20 in the memory and performs correction. Although the present invention covers both configurations, if high-speed printing is intended, it is better to correct the timing at which the print heads perform recording. In the case where the correction data is fed back to rotational speed control of the conveying roller 101, there is a slight time lag between when a command value is given to rotational speed control of a motor serving as the driving source of the conveying rollers and when the rotational speed of the driving motor is changed to the target value. In contrast, in the case where the correction data is fed back to the timing at which the print heads perform recording, because there is almost no time lag compared with the case where it is fed back to the sheet conveyance speed control, correction control at a higher speed becomes possible.

Figure 5:
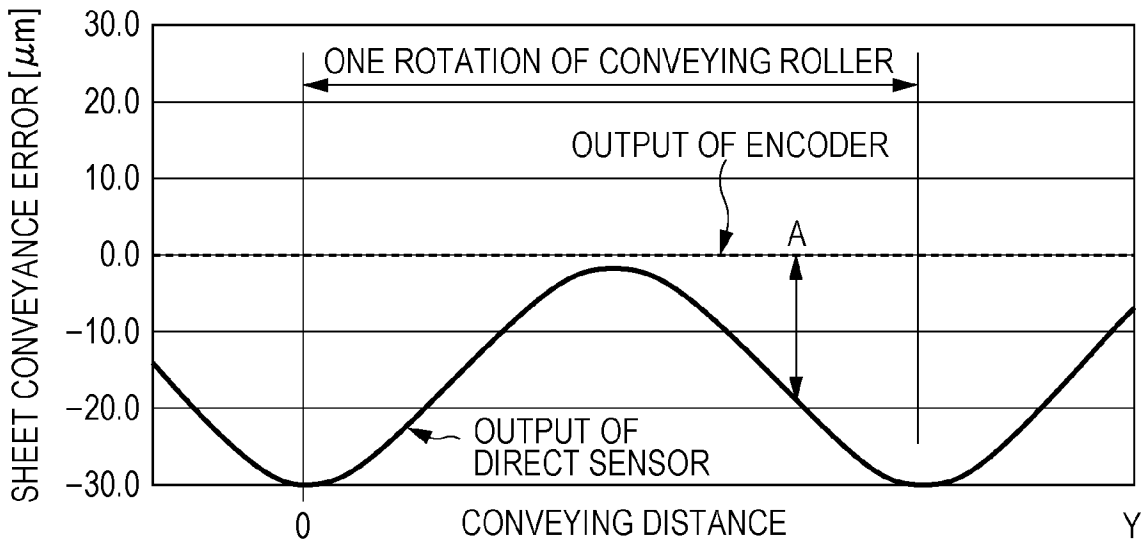
FIG. 5 is a graph showing changes in sheet conveyance error associated with conveyance.

FIG. 5 is a graph showing changes in conveying error associated with sheet conveyance based on the relationship between the detection output of the rotary encoder 19 and the detection output of the direct sensor 20. The horizontal axis shows the conveying distance, and the vertical axis shows the sheet conveyance error (the error in the conveyance amount with respect to the design value). The coordinate 0 on the horizontal axis shows the position of the origin of the encoder, and the unit of the horizontal axis is the pulse number of the rotary encoder 19. The interval of pulses continuously outputted from the rotary encoder 19 during conveyance corresponds to the designed unit moving distance. The rotation phase is obtained from two pieces of information, i.e., the origin and the pulse number count value (=the amount of rotation).

When measurement is performed, during conveyance, the direct sensor 20 detects the moving distance of the sheet, i.e., the distance by which the sheet has actually moved since the preceding pulse is generated, each time the rotary encoder 19 counts one pulse. The solid line in the graph in FIG. 5 is obtained by plotting the difference between the detection value obtained by the direct sensor 20 and the designed unit moving distance (the sheet conveyance error). As can be seen from FIG. 5, the sheet conveyance error fluctuates (increases and decreases) periodically with the conveying distance, indicating that there is irregular conveyance. This irregular conveyance occurs because the rotation shaft of the conveying roller 101 is eccentric. That is, even if the conveying roller is rotated at a constant angular speed, the peripheral speed (=sheet conveyance speed) of the conveying roller at a unit in contact with the sheet periodically fluctuates due to the eccentricity, causing irregular conveyance. Furthermore, in the graph in FIG. 5, the curve (solid line) representing the output of the direct sensor 20, i.e., the conveying error, is generally shifted in the minus direction. This is because the actual conveying distance is smaller than the intended conveying distance because of a slight slippage occurring between the conveying roller 101 and the sheet. Although the outer periphery of the conveying roller 101 is a perfect circle in the example in FIG. 5, in the case where it is not a perfect circle because of a manufacturing error or the like, the graph shows a complicated curve containing periodical increases and decreases and local errors due to a non-perfect circle.

Taking into consideration the characteristics shown in FIG. 5, the plot values (conveying errors) during, at least, the rotation of the conveying roller 101 are associated one to one with the count values (rotation phases) of the encoder pulse from the origin 0, and the resulting data table is stored as the correction data in the memory of the engine control unit 208.

Alternatively, not the errors in the conveyance amount with respect to the design value, but the output values of the direct sensor 20 themselves may be associated one to one with the count values of the encoder pulse from the origin 0, and the resulting data table may be stored in the memory as the correction data. Alternatively, the sheet conveyance error may be converted into time shift of ejection timing (the necessary correction amount) and the resulting data table may be stored in the memory as the correction data. In either case, the control unit controls such that the information (rotation phase) acquired by the first acquisition unit is associated with the information (the sheet conveyance error, the output value of the direct sensor, or the time shift of the ejection timing) acquired by the second acquisition unit, and such that the data is stored in the memory as the correction data. By referring to the data table of the correction data, the appropriate correction value for the rotation phase can be acquired.

Note that, when a pulse motor is used as the driving source for the conveying roller 101, the pulse number of the driving pulse corresponds to the conveying distance. Although the first acquisition unit detects the rotation condition of the conveying roller 101 with the rotary encoder 19, it may acquire rotation information of the conveying roller 101 from the driving pulse of the pulse motor.

Simplex Printing Mode

Figure 6:
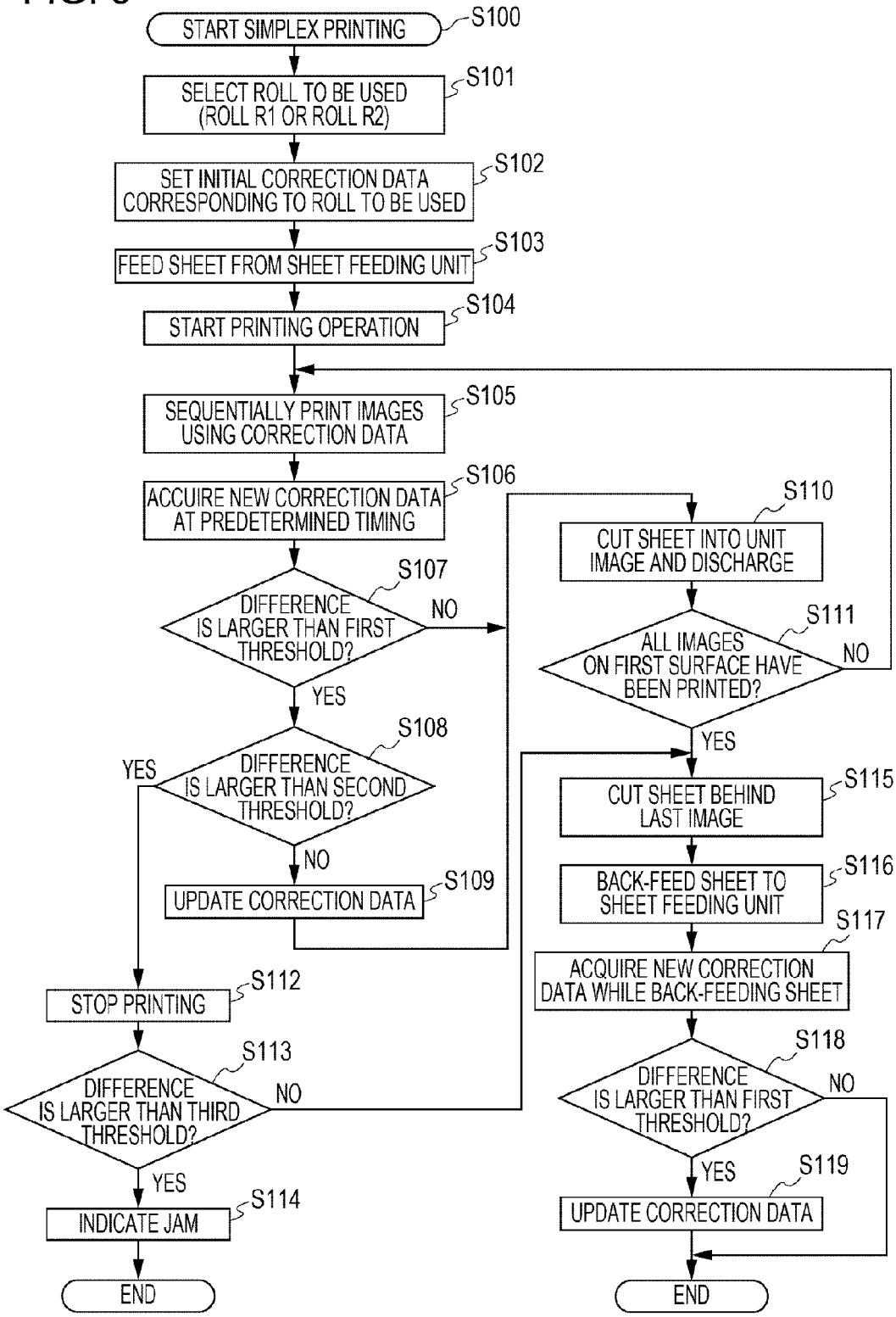
FIG. 6 is a flowchart showing an operation sequence in the simplex printing mode.

Referring to the flowchart in FIG. 6, an operation sequence in the simplex printing mode will be described. The sequence starts in step S100. In step S101, a user selects a roll to be used (roll R1 or roll R2) in the sheet feeding unit 1. Because the coefficient of friction between the sheet and the conveying roller 101 varies according to the type, thickness, or size of the sheet, the most appropriate correction data may differ depending on the sheet to be used.

In step S102, initial correction data corresponding to the roll to be used is set to the memory of the engine control unit 208. If the roll has not been replaced or changed after the previous simplex printing, the same initial correction data as that used previously is set. The memory storing the correction data is a rewritable non-volatile memory, which holds the content stored in the memory while the power of the printing apparatus is off. Therefore, the memory holds the previous correction data even if the power is turned off after the previous printing. If the roll has been replaced or changed, or duplex printing has been performed after the previous simplex printing, the sheet is actually conveyed prior to printing to acquire new correction data, and the initial correction data is set. In this case, the measurement by the direct sensor 20 and the rotary encoder 19 is performed with respect to, at least, one rotation of the conveying roller 101, and the data is stored as the correction data in the memory of the engine control unit 208. Even when an unknown sheet is to be used, by measuring the sheet, the most appropriate correction data can be set.

In step S103, the selected sheet is fed from the sheet feeding unit 1. In step S104, printing operation is started. In step S105, a plurality of images are sequentially printed on the first surface of the sheet utilizing the correction data stored in the memory. The timing at which each line head ejects ink (is driven) is corrected utilizing the correction data stored in the memory. Based on the pulse number outputted from the rotary encoder 19 from the origin, the correction data stored in association with the pulse number is read from the memory. Based on the correction data read from the memory, the timing at which each line head ejects ink is shifted from the intended timing, so that the ink lands at an ideal position of the sheet. In the example of FIG. 5, at the position of the conveying distance A, the error is −20 μm. For example, when the sheet conveyance speed v is 100 mm/s, the ink ejection timing may be delayed by 0.02/100=0.0002 [seconds]. This enables image forming in the second and subsequent jobs to be performed with high accuracy, regardless of the eccentricity and shape accuracy of the conveying roller 101. Thus, during printing, the control unit controls such that printing is performed while correcting the recording timing of the print heads on the basis of the correction data stored in the memory corresponding to the information (rotation phase) acquired by the first acquisition unit.

In step S106, during printing operation, new correction data is acquired at predetermined timing. The predetermined timing will be described below. The measurement by the direct sensor 20 and the rotary encoder 19 is performed with respect to, at least, one rotation of the conveying roller 10. Then, the measurement results obtained from the rotary encoder 19 and the direct sensor 20 are compared. The rotation phase of the conveying roller 101 acquired by the rotary encoder 19 and the moving information acquired by the direct sensor 20 are associated with each other and are temporarily stored in the memory as the correction data.

The use of the printing apparatus may cause the conveying rollers to wear or the attaching accuracy to change, which may change the most appropriate correction data. Taking this into consideration, in step S106, new correction data is acquired at predetermined timing to update the content of the memory. The predetermined timing occurs once in a predetermined number of image printings, when a plurality of images are sequentially printed. Because it is unlikely that the most appropriate correction data is changed every unit image, new correction data is acquired once in several tens to several hundreds of image printings. The content of the memory may be updated by either overwriting the previous data or writing new data in another storage area, while keeping the previous data, and changing the reference address.

In step S107, the difference between the correction data acquired in step S106 and the existing correction data is determined. By comparing two pieces of correction data acquired with respect to one rotation of the roller with each other, the differences in the respective rotation phases are determined. Then, the largest difference is employed. Whether the determined difference is larger than a predetermined first threshold (Yes) or not (No) is determined. If Yes, the process proceeds to step S108, and if No, the process proceeds to step S110.

In step S108, whether the above-described difference is larger than a predetermined second threshold, which is larger than the first threshold, (Yes) or not (No) is determined. If Yes, the process proceeds to step S112, and if No, the process proceeds to step S109.

In step S109, the content of the memory is updated with the new correction data. In step S110, the sheet is cut into each unit image by the cutter unit 6, and the cut sheets are discharged on the discharge unit 12. In step S111, whether all the images to be printed on the first surface have been printed (Yes) or not (No) is determined. If Yes, the process proceeds to step S115, and if No, the process returns to step S105, where the same processing is repeated.

When the process proceeds to step S112 from step S108, the simplex printing is stopped in step S112. In the following step S113, whether the above-described difference is larger than a predetermined third threshold, which is larger than the second threshold, (Yes) or not (No) is determined. If Yes, the process proceeds to step S114, and if No, the process proceeds to step S115.

In step S114, it is determined that a jam occurs during sheet conveyance, and a message indicating that a jam occurs and user maintenance is necessary is indicated on the operating unit 15. When a jam occurs, even though the conveying roller 101 is rotated, the sheet slips and fails to be conveyed or the sheet moves slightly. This increases the difference between the values acquired by the rotary encoder 19 and the direct sensor 20. That is, the new correction data (the amount of correction in each rotation phase) is a large value, and the difference from the existing correction data is also large. The third threshold determines the value of the difference. Although no jam occurs as long as the difference value does not exceed the third threshold, which is larger than the second threshold, the conveying accuracy is degraded for some reason, and accurate printing cannot be guaranteed. Therefore, printing operation is stopped in step S112.

In step S115, the continuous sheet is cut at a position behind (on the upstream side of) the last image. In step S116, the unused sheet remaining on the upstream side of the cutting position is sent back to the sheet feeding unit 1 (back-feed).

In step S117, the new correction data is acquired while back-feeding the sheet. The data is acquired using the method described in step S106. In order to more assuredly acquire the correction data, the sheet conveyance speed during back-feeding is lower than that during printing. Because the back-feeding is performed after printing, a reduction in speed does not affect the overall printing throughput. Note that the content of the memory may be updated with the preliminarily acquired newest correction value during back-feeding, instead of acquiring new correction data while performing back-feeding.

In step S118, the difference between the correction data acquired in step S117 and the existing correction data is determined. Whether the difference is larger than the predetermined first threshold (Yes) or not (No) is determined. If Yes, the process proceeds to step S119, and if No, the step S119 is skipped and the sequence is completed. Because a small difference may be caused by detecting an error, and thus, the reliability is low, step S119 is skipped.

In step S119, the content of the memory is updated with new correction data. Because the memory is a non-volatile memory, it holds the content while the power of the apparatus is off. Thus, the data is used in the next printing operation. Then, the sequence is completed.

In the above-described operation sequence in the simplex printing mode, it is desirable that the sheet conveyance speed during acquisition of the correction data be set lower than that at the normal time. The lower the sheet conveyance speed, the more time the direct sensor 20 can have to perform signal processing. Thus, the processing capacity of the signal processing system can be small. In order to further improve the printing throughput, from step S107 to step S109, and from step S112 to step S114 may be omitted in the operation sequence in FIG. 6. In such a case, the correction data is set twice, i.e., the initial setting in step S102 and the update in step S119.

Duplex Printing Mode

The duplex printing mode will be described below. In duplex printing, the first surface and the second surface of the sheet, with which the conveying roller comes into contact, have different coefficients of friction. In printing on the first surface, the conveying roller 101, which has the greatest influence on the overall conveying accuracy, comes into contact with the second surface of the sheet onto which ink has not yet been ejected. In the following second surface printing, the sheet is reversed, and the conveying roller 101 comes into contact with the first surface onto which the ink has been ejected, and hence, the coefficient of friction thereof has been changed. Some sheets have different coefficients of friction on the first surface and the second surface, regardless of whether or not ink has been ejected. Furthermore, in printing on the first surface and on the second surface, the sheet is curled in different directions, and the area over which the sheet is in contact with the conveying roller 101 differs depending on the direction of the curl. Therefore, in printing on the first surface and on the second surface, the slippage between the conveying roller 101 and the sheet surface is different, and, even when the same driving force is applied, the sheet conveyance condition is different. Accordingly, the most appropriate correction data is different in printing on the first surface and in printing on the second surface. To solve this problem, in this embodiment, different correction data is used in printing on the first surface and in printing on the second surface.

Figure 7:
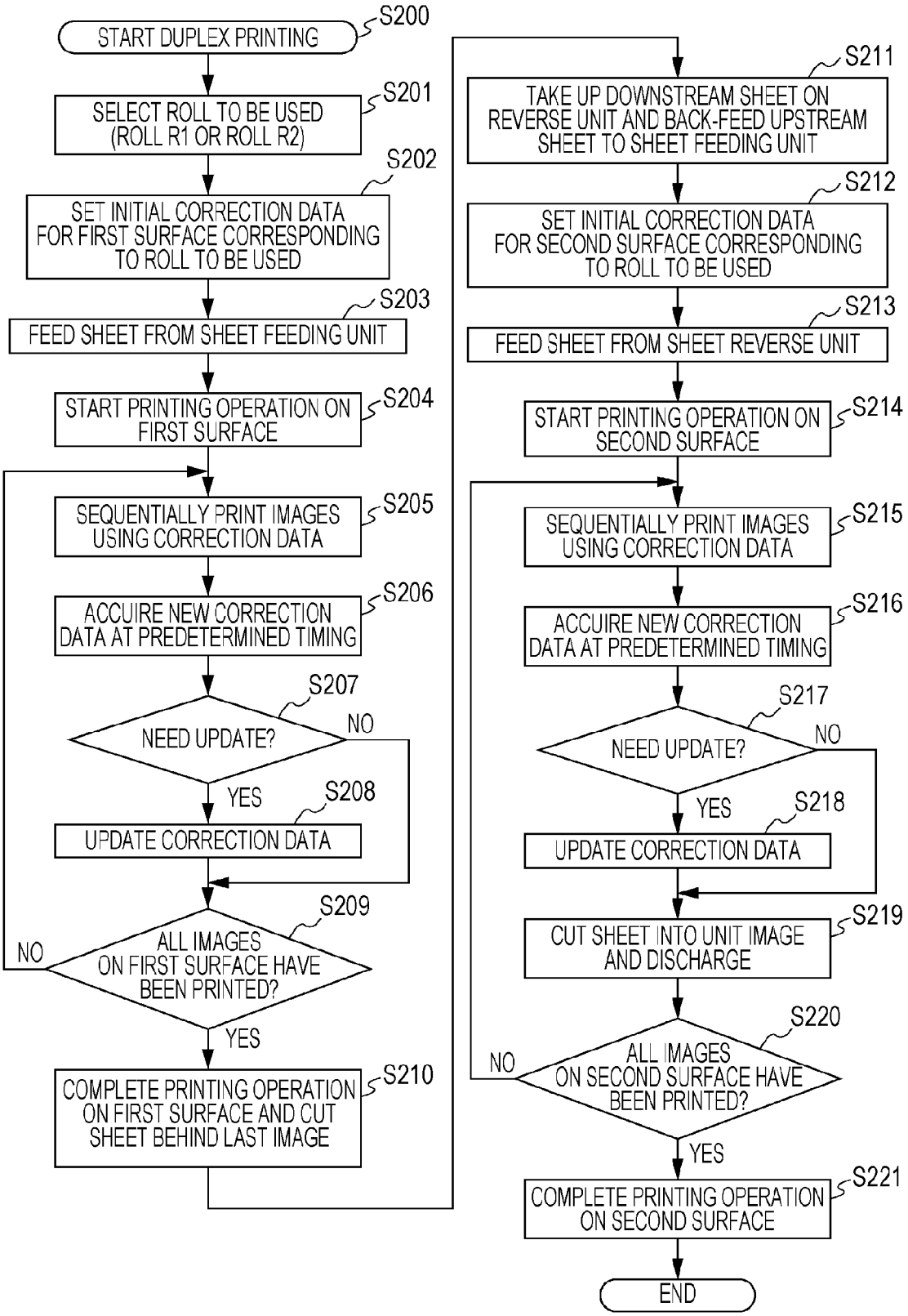
FIG. 7 is a flowchart showing an operation sequence in the duplex printing mode.
Figure 8:
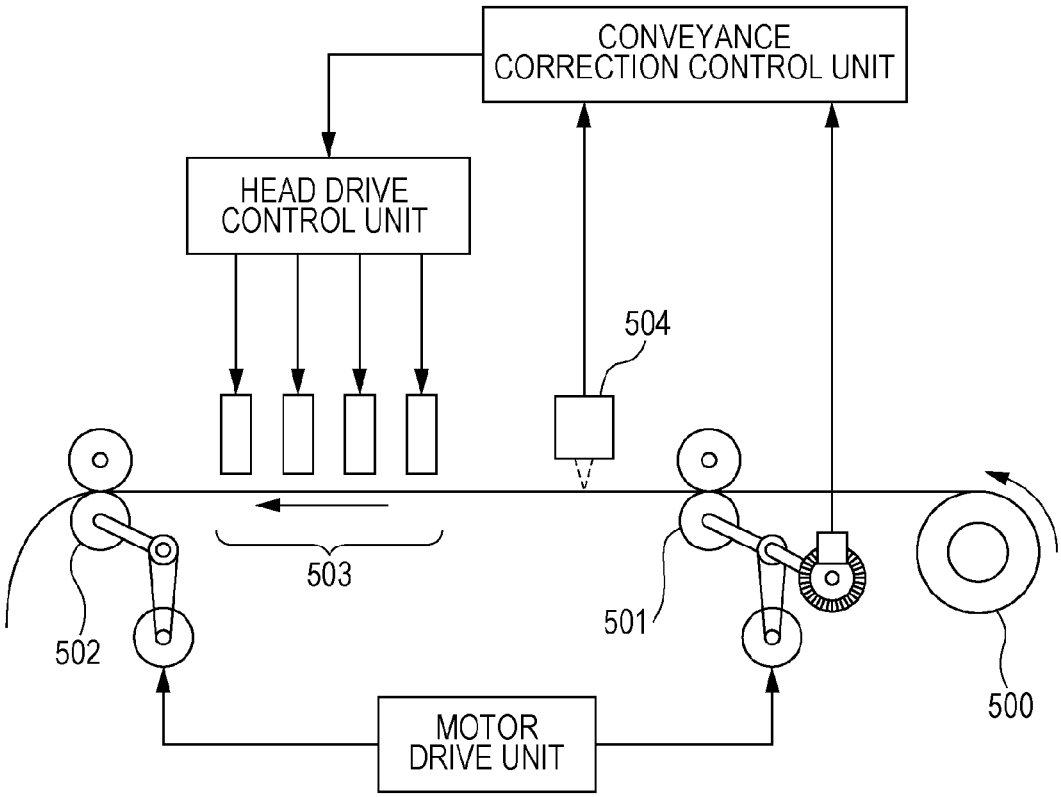
FIG. 8 is a schematic view of a conventional example.

FIG. 7 is a flowchart showing an operation sequence in the duplex printing mode. The sequence starts in step S200. In step S201, a user selects a roll to be used (roll R1 or roll R2) in the sheet feeding unit 1.

In step S202, initial correction data corresponding to the roll to be used and suitable for printing on the first surface is set to the memory of the engine control unit 208. If the roll has not been replaced or changed after the previous printing, the same initial correction data as that used previously is set. If the roll has been replaced or changed, or simplex printing has been performed after the previous duplex printing, the sheet is actually conveyed prior to printing to acquire new correction data, and the initial correction data is set.

In step S203, the selected sheet is fed from the sheet feeding unit 1. In step S204, printing operation on the first surface, in duplex printing, is started.

In step S205, a plurality of images are sequentially printed on the first surface of the sheet utilizing the correction data stored in the memory. The method of correction is the same as that described in step S105.

In step S206, new correction data is acquired at predetermined timing.

In step S207, whether the update of the correction data is necessary (Yes) or not (No) is determined. The method of determination is the same as that described in from step S107 to step S114. If Yes, the process proceeds to step S208, where the correction data is updated. If No, step S208 is skipped, and the process proceeds to step S209.

In step 208, whether all the images to be printed on the first surface have been printed (Yes) or not (No) is determined. If Yes, the process proceeds to step S210, and if No, the process returns to step S205, where the same processing is repeated.

In step S210, the printing operation on the first surface is completed, and the continuous sheet is cut at a position behind (on the upstream side of) the last image. In step S211, the sheet on the downstream side of the cutting position is taken up on the reverse unit 9 completely. At the same time, the unused sheet remaining on the upstream side of the cutting position is sent back to the sheet feeding unit 1.

In step 212, initial correction data corresponding to the roll to be used and suitable for printing on the second surface is set to the memory. As described above, different correction data is used in printing on the first surface and in printing on the second surface. If the roll has not been replaced or changed after the previous duplex printing, the same initial correction data as the previous second surface printing is set. If the roll has been replaced or changed, or simplex printing has been performed after the previous duplex printing, the sheet is actually conveyed prior to printing on the second surface to acquire new correction data, and the initial correction data is set.

In step S213, the winding rotary member of the reverse unit 9 is rotated in the opposite direction, feeding the sheet temporarily taken up thereon to the printing unit 4 in such a manner that the sheet is reversed. In step S214, printing operation on the second surface in duplex printing is started.

In step S215, a plurality of images are sequentially printed on the second surface of the sheet utilizing the correction data stored in the memory. The method of correction is the same as that described in step S105.

In step S216, new correction data is acquired at predetermined timing.

In step S217, whether the update of the correction data is necessary (Yes) or not (No) is determined. The method of determination is the same as that described in step S207. If Yes, the process proceeds to step S218, where the correction data in the memory is updated. If No, step S218 is skipped, and the process proceeds to step S219.

In step S219, the sheet is cut into each unit image by the cutter unit 6, and the cut sheets are discharged on the discharge unit 12. In step S220, whether all images to be printed on the first surface have been printed (Yes) or not (No) is determined. If Yes, the process proceeds to step S221, where printing on the second surface is completed and the sequence is completed if there is no subsequent processing. If No, the sequence returns to step S215, where the same processing is repeated.

In the above-described operation sequence in the duplex printing mode, it is desirable that the sheet conveyance speed during acquisition of the correction data be set lower than that during printing. The lower the sheet conveyance speed, the more time the direct sensor 20 can have to perform signal processing. Thus, the processing capacity of the signal processing system can be small. In order to further improve the printing throughput, from step S206 to step S208 in printing on the first surface and from step S216 to step S218 in printing on the second surface may be omitted in the operation sequence in FIG. 7. In such a case, the correction data is set twice, i.e., the initial setting in step S202 in printing on the first surface and the initial setting in step S212 in printing on the second surface.

With the printing apparatus according to this embodiment, correction data corresponding to the rotation information acquired by the first acquisition unit during printing is read from the memory, and at least one of driving control of the print head and conveyance control of the sheet is corrected. Then, different correction data is used in printing on the first surface and in printing on the second surface. This realizes a printing apparatus capable of duplex printing, which can precisely print images on both surfaces of a sheet and achieve high printing throughput.

Furthermore, when a plurality of images are printed on the continuous sheet and an unused sheet is fed back to the sheet feeding unit, new correction data is acquired and the content of the memory is updated if necessary. Because the appropriate correction data is acquired and stored in the memory at appropriate timing, duplex printing achieving both high printing throughput and high-quality printing is possible.

In addition, the printing apparatus according to this embodiment includes the first roller pair that nips the sheet on the upstream side of the print heads, the second roller pair that nips the sheet on the downstream side of the print heads, and the third roller pair that nips the sheet on the upstream side of the first roller pair. The direct sensor that measures the sheet surface is disposed at the measurement position between the nip position of the first roller pair and the nip position of the third roller pair. This configuration provides the following advantages.

1. The distance between the first roller pair and the print heads can be reduced. Therefore, it is possible to reduce the likelihood of the leading end of the sheet floating touching nozzles in the print head on the most upstream side, when the sheet is introduced and passes from the first roller pair to the print heads.

2. Because the distance between the direct sensor and the print heads is large, there is plenty of time to perform calculation in the direct sensor and control ink ejection timing while the sheet moves from the measurement position of the direct sensor to the print head on the most upstream side. In other words, it is possible to further increase the sheet conveyance speed to increase the printing speed.

3. Because the distance between the direct sensor and the print heads is large, and because the first roller pair is disposed therebetween, it is possible to prevent cockling, which occurs when the sheet absorbs ink immediately after printing, from affecting the measurement position.

4. Because the distance between the direct sensor and the print heads is large, and because the first roller pair and the sheet are disposed therebetween, deposition of ink mist produced and scattered when ink is ejected from the print heads on the direct sensor is reduced. Accordingly, it is possible to maintain high measurement accuracy of the direct sensor even in a long-term operation, whereby it is possible to maintain high printing quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-109544 filed May 11, 2010, which is hereby incorporated by reference herein in its entirety.

What is claimed is:

1. An apparatus capable of duplex printing, the apparatus comprising:

a sheet feeding unit configured to feed a continuous sheet;

a conveying mechanism including a roller configured to be provided with driving force, configured to convey the sheet;

a printing unit including a line print head, configured to perform printing on the sheet conveyed by the conveying mechanism;

a reverse unit configured to reverse the sheet for the duplex printing, wherein, in the duplex printing, the printing unit performs printing a plurality of images on a first surface of the sheet fed from the sheet feeding unit, the printed sheet is reversed by the reverse unit to feed the reversed sheet to the printing unit again, and the printing unit performs printing a plurality of images on a second surface, which is a back of the first surface, of the sheet fed from the reverse unit;

a first acquisition unit configured to acquire rotation information of the roller;

a second acquisition unit configured to acquire information about a movement state of the sheet by measuring a surface of the conveyed sheet; and a control unit including a memory, wherein correction data is acquired and stored in the memory prior to beginning the duplex printing by associating information acquired by the first acquisition unit with information acquired by the second acquisition unit with respect to at least one rotation of the roller, wherein the correction data contains first correction data configured to be used in printing on the first surface while the roller contacts the second surface to convey the sheet, and second correction data that is different from the first correction data and is configured to be used in printing on the second surface while the roller contacts the first surface to convey the sheet, wherein the control unit reads the correction data corresponding to the rotation information acquired by the first acquisition unit from the memory during printing on each of the first surface and the second surface to correct at least one of driving control of the line print head and driving control of the roller.

2. The apparatus according to claim 1, wherein the control unit updates the correction data stored in the memory at predetermined timing.

3. The apparatus according to claim 2, wherein, in response to the sheet being fed back to the sheet feeding unit, the control unit updates the correction data.

4. The apparatus according to claim 2, wherein the control unit acquires new correction data at the predetermined timing and updates the correction data stored in the memory when a difference between the new correction data and existing correction data is larger than a first threshold.

5. The apparatus according to claim 4, wherein, in response to the difference being larger than a predetermined second threshold that is larger than the first threshold, the control unit stops printing.

6. The apparatus according to claim 5, wherein, in response to the difference being larger than a predetermined third threshold that is larger than the second threshold, the control unit determines that a jam occurs.

7. The apparatus according to claim 1, wherein sheet conveyance speed during acquisition of the correction data before beginning the duplex printing is lower than sheet conveyance speed during the duplex printing.

8. The apparatus according to claim 1, wherein the sheet feeding unit can hold first and second rolls of the continuous sheet and can selectively feed one of the first and second rolls, and wherein the correction data corresponding to the first roll and the correction data corresponding to the second roll are stored in the memory respectively.

9. The apparatus according to claim 8, wherein the memory includes a rewritable non-volatile memory, which can hold stored content even when power of the apparatus is off.

10. The apparatus according to claim 1, wherein the first acquisition unit includes a rotary encoder that detects a rotation condition of the roller, and the second acquisition unit includes a laser Doppler sensor.

11. The apparatus according to claim 1, further comprising a pulse motor that provides the roller with driving force, wherein the first acquisition unit acquires rotation information of the roller from driving pulses for driving the pulse motor.

12. The apparatus according to claim 1, wherein the conveying mechanism includes a first roller pair that nips the sheet at an upstream side of the line print head to convey the sheet, a second roller pair that nips the sheet at a downstream side of the line print head to convey the sheet, and a third roller pair that nips the sheet at an upstream side of the first roller pair to convey the sheet, wherein the roller is a driving roller constituting the second roller pair, and wherein the second acquisition unit measures the sheet surface at a measurement position between the nip position of the first roller pair and the nip position of the third roller pair.

13. The apparatus according to claim 12, wherein the first roller pair, the second roller pair, and the third roller pair are each provided with driving force, wherein conveying force for conveying the sheet satisfies a conveying force relationship: the first roller pair>the second roller pair>the third roller pair whereby the first roller pair, residing between the second roller pair and the third roller pair, has an influence on a sheet conveyance accuracy that is greater than sheet conveyance accuracy influence provided by either the second roller pair and the third roller pair to improve an overall sheet conveyance accuracy, and wherein sheet conveyance speed satisfies: the second roller pair>the first roller pair>the third roller pair such that a downstream sheet conveyance speed exceeds an upstream sheet conveyance speed which, along with the conveying force relationship, work to reduce slippage at the roller at which the first acquisition unit acquires rotation information and to obtain more accurate information regarding conveying error caused by defect related to the roller.

14. The apparatus according to claim 12, wherein the second acquisition unit measures a back side of a printing side of the sheet.

15. The apparatus according to claim 1, wherein the second acquisition unit measures a back side of a printing side of the sheet and is positioned so that the continuous sheet passes between the line print head facing the printing side and the second acquisition unit facing the back side to provide blockage of ink mist from the line print head to the second acquisition unit and prevent degradation in detection performance by the second acquisition unit.

16. The apparatus according to claim 15, wherein the second acquisition unit includes at least two second acquisition unit provided in a sheet width direction.

17. The apparatus according to claim 1, wherein the roller is a conveying roller, and wherein the first acquisition unit is provided on the conveying roller.

* * * * *